US007770352B2

(12) United States Patent
Plasek et al.

(10) Patent No.: US 7,770,352 B2
(45) Date of Patent: Aug. 10, 2010

(54) SHUTTER SYSTEM

(76) Inventors: Scott A. Plasek, 2937 Woodway Dr., Flower Mound, TX (US) 75028; Derek Stuth, 2525 Highway 360, Apt. 2017, Euless, TX (US) 76039

( * ) Notice: Subject to any disclaimer, the term of this patent is extended or adjusted under 35 U.S.C. 154(b) by 559 days.

(21) Appl. No.: 11/796,244

(22) Filed: Apr. 27, 2007

(65) Prior Publication Data

US 2008/0263992 A1 Oct. 30, 2008

(51) Int. Cl.
*E04C 2/38* (2006.01)
*E06B 1/04* (2006.01)

(52) U.S. Cl. ..... 52/717.01; 52/211; 52/312

(58) Field of Classification Search ..... 52/717.01, 52/211, 716.4, 716.7, 718.04, 718.06, 718.03, 52/312, 202, 222, 212, 204.53, 710, 489.1, 52/489.2, 204.54, 204.7, 288.1, 716.6; 403/329, 403/387, 396; 256/59, 65.01
See application file for complete search history.

(56) References Cited

U.S. PATENT DOCUMENTS 1,804,831 A * 5/1931 Hardesty ..... 52/716.7
2,116,846 A * 5/1938 Pilcher ..... 52/312
2,365,478 A * 12/1944 La Grotta ..... 52/242
2,676,680 A * 4/1954 Kindorf ..... 403/22
2,936,667 A * 5/1960 Thorberg ..... 411/393
3,304,681 A * 2/1967 Wunderlich ..... 52/204.591
3,363,382 A * 1/1968 Forrest ..... 52/464
3,423,897 A * 1/1969 Birum, Jr. ..... 52/773
3,720,030 A * 3/1973 Krodel ..... 52/204.597
3,775,926 A * 12/1973 Brown et al. ..... 52/718.02
3,956,861 A * 5/1976 Rasmussen ..... 52/288.1
3,991,537 A * 11/1976 Brown ..... 52/718.05
4,020,609 A 5/1977 Daniels
4,066,285 A * 1/1978 Hall et al. ..... 293/120
4,399,640 A * 8/1983 Porter ..... 52/202
4,586,301 A * 5/1986 Hickman ..... 52/96
4,586,697 A * 5/1986 Tornya ..... 256/65.11
4,603,528 A * 8/1986 Sigerist ..... 52/464
4,805,879 A * 2/1989 Spera ..... 256/65.12
4,946,727 A * 8/1990 Kessler ..... 428/99
5,083,409 A * 1/1992 Pliml, Jr. ..... 52/656.9
5,199,836 A * 4/1993 Gogarty ..... 411/84
5,222,343 A * 6/1993 Anderson ..... 52/718.04
5,283,096 A * 2/1994 Greenberg et al. ..... 428/67
5,823,727 A * 10/1998 Lee ..... 411/85
5,882,745 A 3/1999 Mi et al.
5,924,255 A * 7/1999 Vagedes ..... 52/473
6,173,542 B1 * 1/2001 Wright ..... 52/211
6,344,268 B1 2/2002 Stucky et al.
6,378,931 B1 * 4/2002 Kolluri et al. ..... 296/146.15
6,381,915 B1 * 5/2002 Wood ..... 52/718.06
6,474,038 B2 * 11/2002 Nien et al. ..... 52/717.01
6,662,515 B2 12/2003 Buhrts et al.
6,729,092 B2 * 5/2004 Grosjean ..... 52/395
6,841,231 B1 1/2005 Liang et al.
6,846,140 B2 * 1/2005 Anderson et al. ..... 410/104
6,863,972 B2 3/2005 Burger et al.
7,074,918 B2 7/2006 Medoff et al.

(Continued)

*Primary Examiner*—Robert J Canfield
*Assistant Examiner*—Brent W Herring

(57) ABSTRACT

A shutter system having a clip that facilitates installation of a decorative cover over a frame rail is provided. The shutter system includes a frame rail, a clip and a decorative cover, the clip being installed in a channel on the frame rail and engaging a channel on the decorative cover to provide a secure fit.

4 Claims, 5 Drawing Sheets

U.S. PATENT DOCUMENTS

| | | | | |
|---|---|---|---|---|
| 7,086,206 | B2 * | 8/2006 | Wang et al. | 52/506.01 |
| 7,174,691 | B2 * | 2/2007 | de Garay Arellano | 52/716.1 |
| 7,438,284 | B2 * | 10/2008 | McGinness et al. | 256/59 |
| 7,503,150 | B1 * | 3/2009 | diGirolamo et al. | 52/702 |
| 2002/0121067 | A1 * | 9/2002 | Nien et al. | 52/717.01 |
| 2002/0178684 | A1 * | 12/2002 | Barnett | 52/716.1 |
| 2004/0170818 | A1 | 9/2004 | Stucky et al. | |
| 2005/0058822 | A1 | 3/2005 | Ittel | |
| 2005/0200050 | A1 | 9/2005 | Medoff et al. | |
| 2006/0065993 | A1 | 3/2006 | Stucky et al. | |
| 2006/0162266 | A1 | 7/2006 | Hay, III | |
| 2007/0154257 | A1 * | 7/2007 | Guttormsen | 403/329 |
| 2008/0190046 | A1 * | 8/2008 | Hecht et al. | 52/173.1 |
| 2008/0216428 | A1 * | 9/2008 | Carvalhais | 52/312 |

* cited by examiner

SHUTTER SYSTEM

BACKGROUND

1. Field of the Invention

The present invention relates generally to window shutters and more particularly to systems for securing shutters to a wall while providing a finished look.

2. Description of Related Art

Within the window design industry, and in particular within the shutter market, there are several known options for designing and securing a shutter to a wall in a decorative manner. As discussed in U.S. Pat. No. 6,474,038 to Nien, et al, the standard method of nailing or screwing a wood shutter to a wall leaves a marred surface where the nail or screw passes through the finished surface. This requires that the surface be finished after securing or that the finish be touched up after securing.

Nien provides one solution to this problem involving a concealing strip placed into a mounting channel. This solution requires very tight manufacturing tolerances to ensure a friction fit between the concealing strip and the mounting channel. Such tight tolerances increase the cost of manufacturing and the return rate of products due to minor damage, such as warping. Other problems, such as material reactions to humidity and temperature changes, may limit the application of the Nien method.

A final issue with the Nien system is that the concealing strip fits within the mounting channel, thereby limiting the decorative variations available for a given rail. The Nien concealing strip can only change the profile of the shutter rail between the edges of the channel.

A need exists, therefore, for a system that provides a concealing cover that may be attached in a way that does not require tight manufacturing tolerances and the attendant costs. The method will also need to be simple enough for consumers to perform without extensive directions to avoid excessive returns.

All references cited herein are incorporated by reference to the maximum extent allowable by law. To the extent a reference may not be fully incorporated herein, it is incorporated by reference for background purposes and indicative of the knowledge of one of ordinary skill in the art.

BRIEF SUMMARY OF THE INVENTION

The problems presented in the shutter arts are solved by the systems and methods of the present invention. In accordance with one embodiment of the present invention, a shutter clip is provided along with matching channels in the frame rail and concealing cover to allow for simple and secure installation of the concealing strip without the limitations of the prior art.

Other objects, features, and advantages of the present invention will become apparent with reference to the drawings and detailed description that follow.

DETAILED DESCRIPTION OF THE PREFERRED EMBODIMENT

All references cited herein are incorporated by reference to the maximum extent allowable by law. To the extent a reference may not be fully incorporated herein, it is incorporated by reference for background purposes and indicative of the knowledge of one of ordinary skill in the art.

In the following detailed description of the preferred embodiments, reference is made to the accompanying drawings which form a part hereof, and in which is shown by way of illustration specific preferred embodiments in which the invention may be practiced. These embodiments are described in sufficient detail to enable those skilled in the art to practice the invention, and it is understood that other embodiments may be utilized and that logical mechanical and electrical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense, and the scope of the present invention is defined only by the appended claims.

Figure 1:
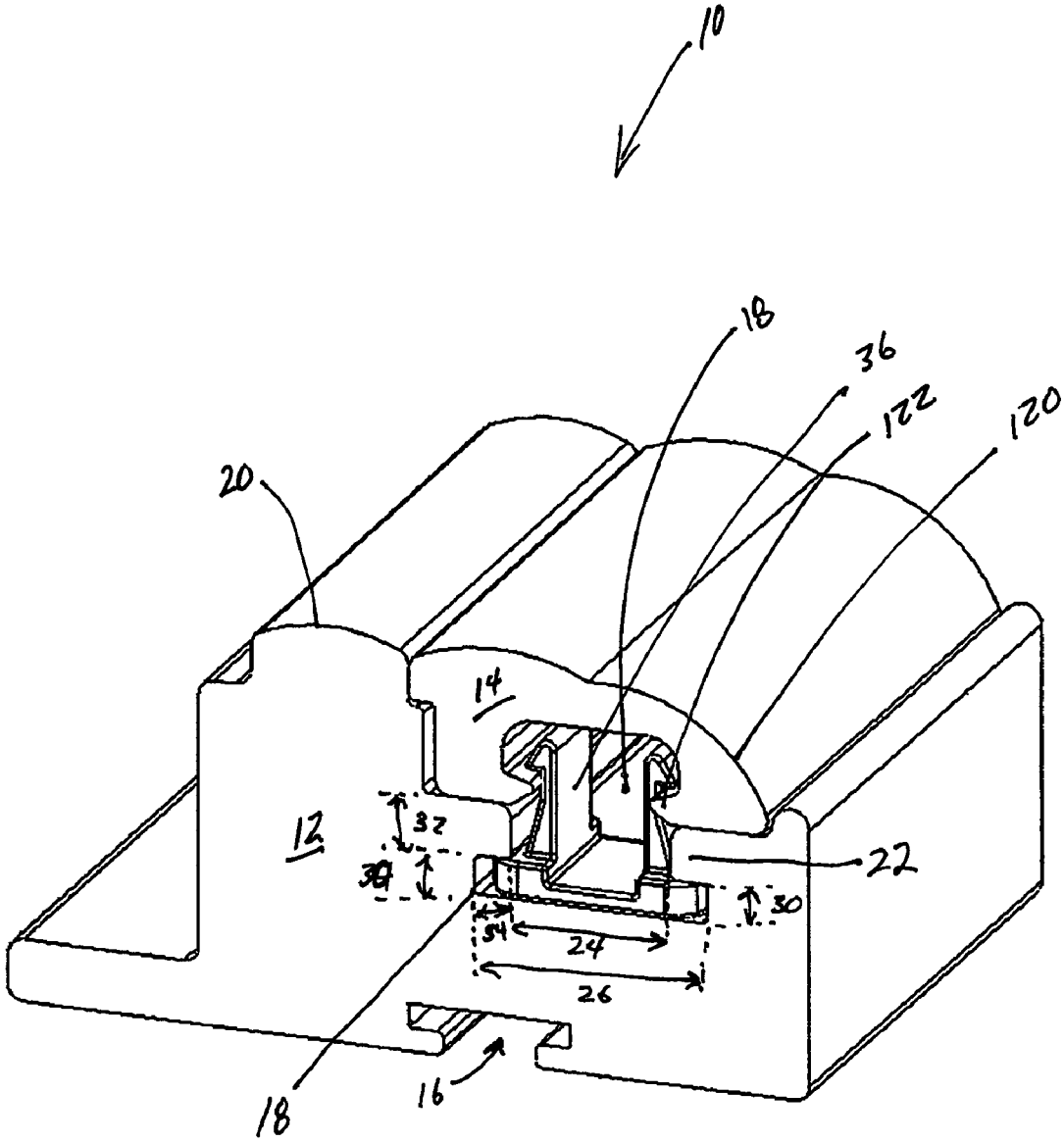
FIG. 1 is a perspective view of a sectioned shutter system.
Figure 5:
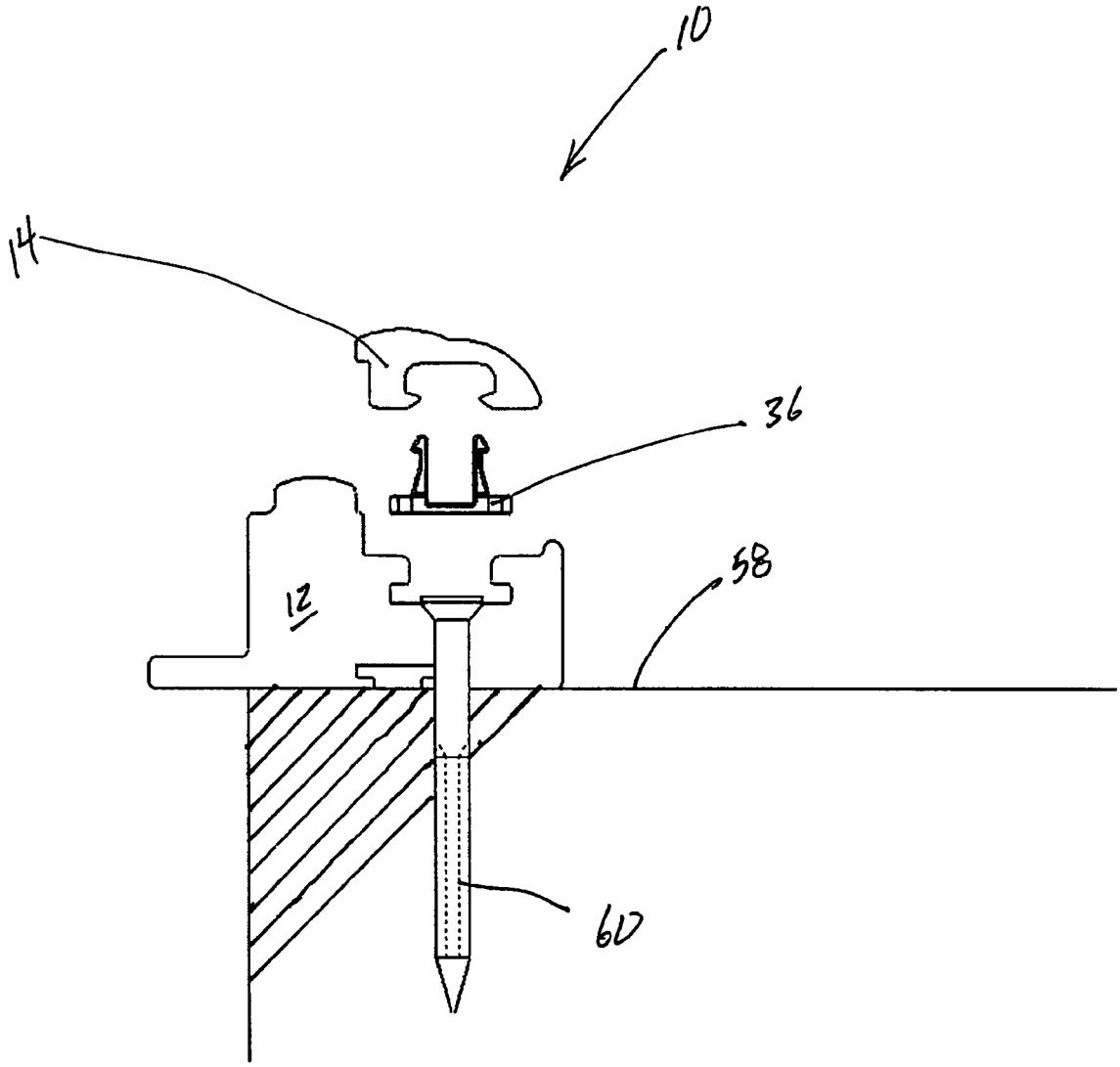
FIG. 5 is a sectional view of a shutter system shown attached to a wall surface with the cover and clip removed.

FIG. 1 is a perspective view of a sectioned shutter system 10 having a frame rail 12 and a decorative cover 14. Typically a shutter is comprised of four frame rails 12 attached in a rectangle to create the frame of the shutter, as is well know in the art. Frame rail 12 has a mounting channel 16 located on the back side to assist in hanging the frame rail on a mounting clip as well as providing a recess for corner securing hardware, as is known in the art. The front of frame rail 12 has a rail channel 18 through which securing hardware may be passed, as shown in FIG. 5. Frame rail 12 has a rail profile 20 defined by its top surface. Rail channel 18 is defined by rail lips 22 that extend from the sides of rail channel 18. Rail lips 22 are shown extending from each side of rail channel 18 in the preferred embodiment to form a narrow rail channel lip width 24 and a wider rail channel bottom width 26. The space between the bottoms of the lips 22 and the bottom of the channel 18 is the lip height 30 while the distance from the bottom of the lips to the top of the lips is the lip thickness 32. The distance from the edge of the lip 22 to the walls of the channel 18 is the lip depth 34.

Decorative cover 14 has a similar channel 118 and decorative profile 120. Cover channel 118 has features similar to rail channel 18, such as cover channel lips 122, cover channel lip width 124, cover channel bottom width 126, cover channel depth 128, cover channel lip height 130, cover channel lip thickness 132, and cover channel lip depth 134 as shown in FIG. 1.

Continuing with FIG. 1 the shutter system 10 uses a clip 36 to secure decorative cover 14 to frame rail 12. Clip 36 has a base 38 designed for insertion into rail channel 18 and engagement of lips 22. Clip 36 also has at least one arm 40 that extend from base 38, each arm having a head 42. Clip 36 as shown has two arms 38, and corresponding heads 42, extending from base 38. Heads 42 have ledges 44 to engage cover lips 122. Heads 42 also have slopes 46 to allow lips 122 to deflect arms 40 and pass over head 42.

Figure 2:
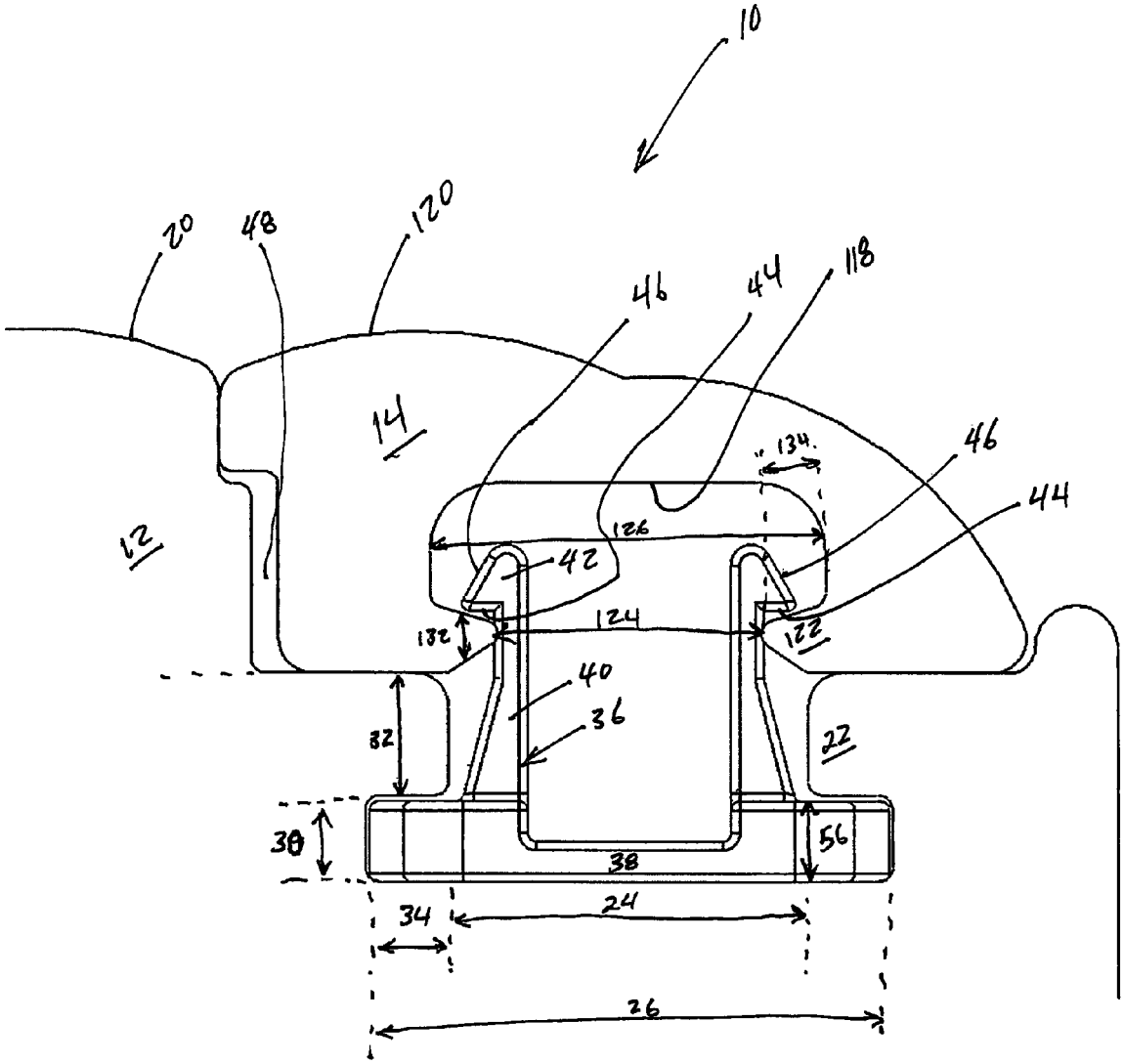
FIG. 2 is a sectional view of the shutter system in FIG. 1.

FIG. 2 is a sectional view of the shutter system 10 in FIG. 1 showing the parts described above. Also shown is the clearance 48 between cover profile 120 and rail profile 20 that is allowed by this system 10. Because clip 36 locks cover 14 to rail 12 there does not have to be a fine tolerance between the cover profile 120 and rail profile 20. This also allows for expansion and shrinkage of rail 12 and cover 14, even if made of differing materials.

Figure 3:
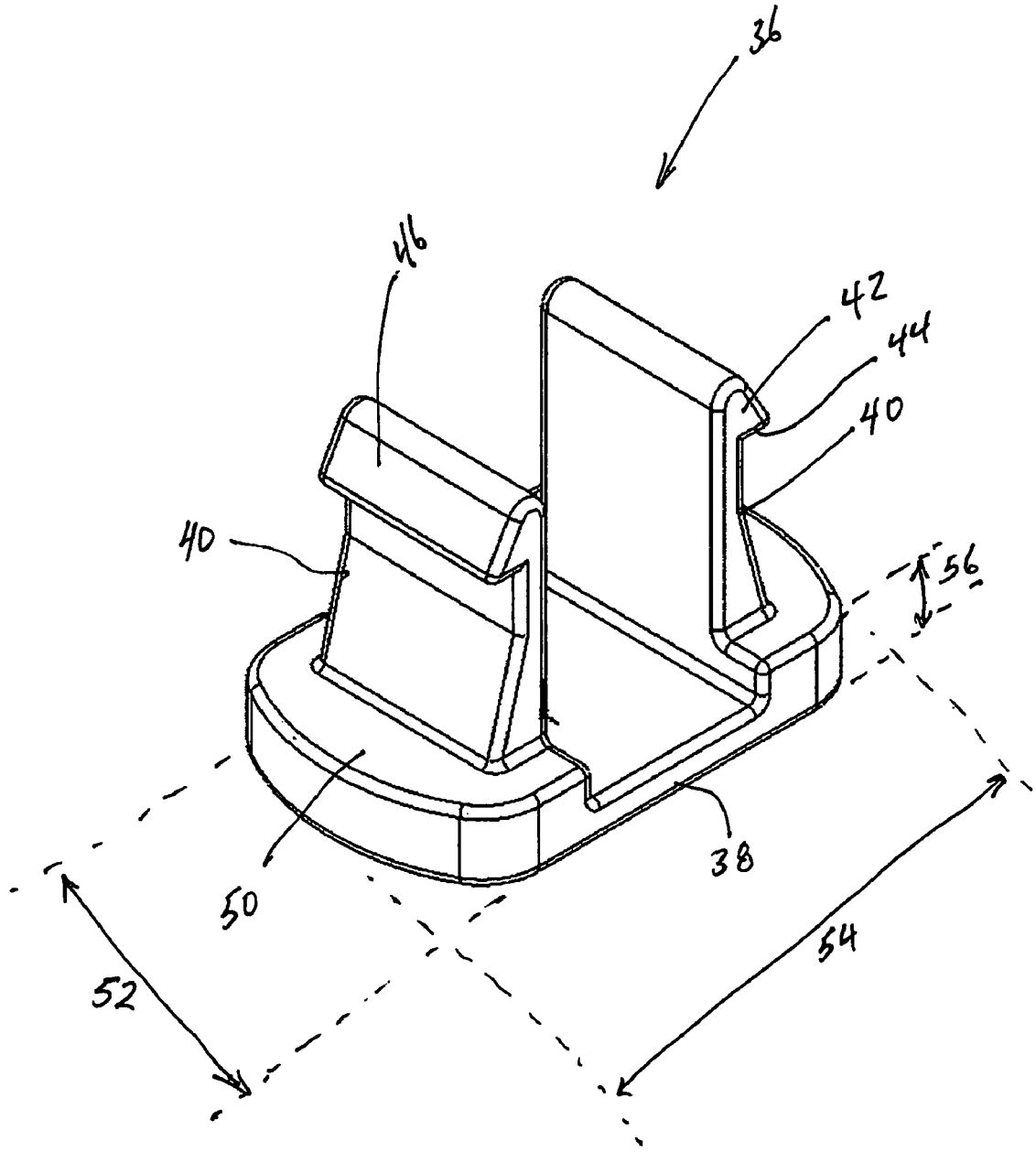
FIG. 3 is a perspective view of the shutter clip shown in FIGS. 1 and 2.

FIG. 3 is a perspective view of the shutter clip 36 shown in FIGS. 1 and 2 and gives a better view of base 38. Base 38 has a width 52 and a length 54, but is defined by shoulders 50 that extend beyond arms 40. Shoulders 50 lock under rail channel lips 22. To be positioned easily base width 52 should be slightly less than rail channel lip width 24 and base length 54 should be slightly less than or equal to rail channel bottom width 26. This allows base 38 of clip 36 to pass between lips 22 and then be rotated 90 degrees so that shoulders 50 engage lips 22. In the preferred embodiment shoulders 50 are rounded, as shown to facilitate the rotation of clip 36. Additionally, shoulders 50 have a thickness 56 about the same as lip height 30.

Arms 40 of clip 36 are shown positioned to extend between lips 22 once clip 36 is installed as described above. Arms 40 have a thickness that is based on the material used and the amount of deflection required to allow heads 42 to engage cover lips 122. A stiffer arm 40 may make installation difficult, or even damage cover 14 while a thin arm 40 may break easily or provide a loose fit. Heads 42 have a ledge 44 that is shown parallel to but spaced apart from shoulder 50. The space between ledge 44 and shoulder 50 is the sum of rail lip thickness 30 and cover lip thickness 130.

Figure 4:
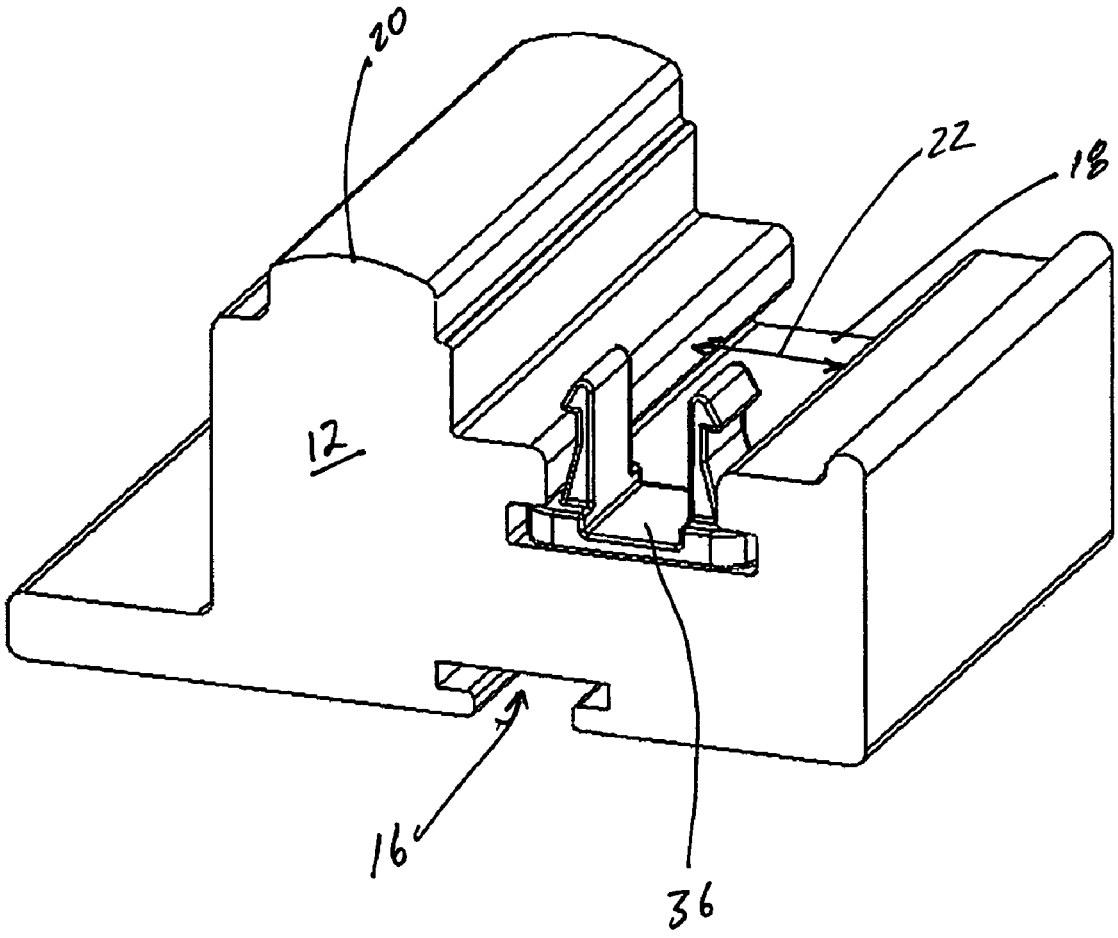
FIG. 4 is a perspective view of a sectioned shutter system with the concealing cover removed.

FIG. 4 is a perspective view of a sectioned shutter system 10 with the concealing cover 14 removed thereby revealing rail channel 18 and rail profile 20 more clearly. Clip 36 is shown installed awaiting cover 14. In use multiple clips 36 may be used along the length of frame rail 12 to secure cover 14. The number of clips 36 used would be determined by the length of frame rail 12.

FIG. 5 is a sectional view of a shutter system 10 shown attached to a wall surface 58 with the cover 14 and clip 36 removed. Rail 12 is shown attached with a screw 60, although nails, bolts and other attachment means are known and would work with this system 10. In a typical installation a shutter is assembled of four frame rails 12. The top rail 12 may be hung on mounts that engage mounting channel 16 or may simply be attached as shown with a screw 60, similar means. The other rails 12 of the shutter are typically nailed or screwed to the wall 58 as shown in FIG. 5. After the frame rails 12 are secured to the wall 58 clips 36 are installed in rail channels 18 as described above. Then decorative covers 14 may be snapped over the protruding heads 42 of clips 36 thereby securing covers 14 of rails 12.

The primary advantage of the present invention is an easy and secure installation without the cost of high tolerance manufacturing.

It should be apparent from the foregoing that an invention having significant advantages has been provided. While the invention is shown in only a few of its forms, it is not just limited but is susceptible to various changes and modifications without departing from the spirit thereof.

We claim:

1. A shutter system comprising:

a frame rail having a rail channel with at least one rail lip, wherein the rail channel has two opposing rail lips defining a lip width of the rail channel;

a concealing cover having a cover channel with at least on cover lip; and a clip inserted into the frame rail to engage the at least one rail lip, the clip having at least one arm with a ledge such that the ledge engages the cover lip when the cover is placed over the rail channel of the frame rail wherein the clip has a base with a base length and a base width, the base width being less than or equal to the lip width of the rail channel and the base length being greater than the lip width of the rail channel such that the base may be positioned with the base length parallel to the rail channel to pass through the lip width upon insertion into the rail channel and then rotated such that the base length is perpendicular to the rail channel and the base extends underneath the rail lips.

2. The shutter system according to claim 1 wherein the base of the clip has rounded corner to ease rotation of the clip within the rail channel.

3. A shutter system comprising:

a frame rail having a rail channel with at least one rail lip, wherein the rail channel has two opposing rail lips defining a lip width of the rail channel;

a concealing cover having a cover channel with at least on cover lip wherein the cover channel has at least two opposing cover lips defining a lip width of the cover channel; and a clip inserted into the frame rail to engage the at least one rail lip, the clip having at least one arm with a ledge such that the ledge engages the cover lip when the cover is placed over the rail channel of the frame rail, wherein the clip has at least two arms extending from a base to engage the opposing cover lips of the cover channel, wherein the at least two arms of the clip are have outer surfaces that are a distance equal to or less than the lip width of the cover channel wherein the at least two arms of the clip extend from the base and each arm has a ledge spaced from the base by the length of the arm, wherein the clip has a base with a with a base length and a base width, the base width being less than or equal to the lip width of the rail channel and the base length being greater than the lip width of the rail channel such that the base may be positioned with the base length parallel to the rail channel to pass through the lip width upon insertion into the rail channel and then rotated such that the base length is perpendicular to the rail channel and the base extends underneath the rail lips.

4. The shutter system according to claim 3 wherein the base of the clip has rounded corner to ease rotation of the clip within the rail channel.

* * * * *